US011940171B2

(12) United States Patent
Anderson et al.

(10) Patent No.: US 11,940,171 B2
(45) Date of Patent: Mar. 26, 2024

(54) DIFFUSER ADJUSTMENT ASSEMBLY SYSTEMS AND METHODS

(71) Applicant: Air Distribution Technologies IP, LLC, Milwaukee, WI (US)

(72) Inventors: Justin Eagan Anderson, Sachse, TX (US); Ramesh Parjapat, Tadipatri (IN); Neal Thomas Holden, Allen, TX (US); Mark James Costello, Sr., Plano, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 37 days.

(21) Appl. No.: 17/578,247

(22) Filed: Jan. 18, 2022

(65) Prior Publication Data

US 2022/0228769 A1 Jul. 21, 2022

Related U.S. Application Data

(60) Provisional application No. 63/139,182, filed on Jan. 19, 2021.

(51) Int. Cl.
*F24F 13/06* (2006.01)

(52) U.S. Cl.
CPC ..... *F24F 13/06* (2013.01)

(58) Field of Classification Search
CPC ..... F24F 13/06; F24F 2013/1473; F24F 13/1413; B60H 1/345
See application file for complete search history.

(56) References Cited

U.S. PATENT DOCUMENTS

2016/0313025 A1* 10/2016 Nemoto ..... F24F 13/1426
2019/0193526 A1* 6/2019 Stark ..... F24F 13/15
2020/0207186 A1* 7/2020 Nemoto ..... B60H 1/345

* cited by examiner

*Primary Examiner* — Edelmira Bosques
*Assistant Examiner* — Michael James Giordano
(74) *Attorney, Agent, or Firm* — Fletcher Yoder, P.C.

(57) ABSTRACT

A diffuser assembly includes a first blade pivotably coupled to a housing and configured to rotate about a first axis and includes second blade pivotably coupled to the housing and configured to rotate about a second axis. The diffuser assembly includes a linkage mechanism coupled to the first blade and the second blade and configured to transition between a first configuration and a second configuration. In the first configuration, the linkage mechanism is configured to induce rotation of the second blade about the second axis in a first direction in response to rotation of the first blade about the first axis in the first direction. In the second configuration, the linkage mechanism is configured to induce rotation of the second blade about the second axis in a second direction, opposite the first direction, in response to rotation of the first blade about the first axis in the first direction.

20 Claims, 14 Drawing Sheets

DIFFUSER ADJUSTMENT ASSEMBLY SYSTEMS AND METHODS

CROSS-REFERENCE TO RELATED APPLICATIONS

This application claims priority from and the benefit of U.S. Provisional Application No. 63/139,182, entitled "AIR DIFFUSER WITH SWITCHABLE BLADE CONFIGURATIONS," filed Jan. 19, 2021, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature and humidity, for occupants of the respective environments. The HVAC system may regulate the environmental properties through delivery of a conditioned air flow to the environment. For example, the HVAC system generally includes an HVAC unit that is fluidly coupled to various rooms or spaces within the building via an air distribution system, such as a system of ductwork. The HVAC unit may be operable to direct a heated air flow or a cooled air flow through the ductwork and into the spaces to be conditioned. In this manner, the HVAC unit facilitates regulation of environmental parameters within the rooms or spaces of the building. Generally, one or more diffuser assemblies are fluidly coupled to the ductwork and are configured to facilitate distribution of conditioned air into the rooms or spaces serviced by the HVAC system. Unfortunately, it may be arduous, time consuming, and/or infeasible to adjust a manner in which conventional diffuser assemblies direct the conditioned air into the spaces of the building.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a diffuser assembly for a heating, ventilation, and air conditioning (HVAC) system. The diffuser assembly includes a housing configured to receive an air flow and a first blade pivotably coupled to the housing and configured to rotate about a first axis relative to the housing. The diffuser assembly also includes a second blade pivotably coupled to the housing and configured to rotate about a second axis relative to the housing. The diffuser assembly also includes a linkage mechanism coupled to the first blade and the second blade, where the linkage mechanism is configured to transition between a first configuration and a second configuration. In the first configuration, the linkage mechanism is configured to induce rotation of the second blade about the second axis in a first direction in response to rotation of the first blade about the first axis in the first direction. In the second configuration, the linkage mechanism is configured to induce rotation of the second blade about the second axis in a second direction, opposite the first direction, in response to rotation of the first blade about the first axis in the first direction.

The present disclosure also relates to a diffuser assembly for a heating, ventilation, and air conditioning (HVAC) system. The diffuser assembly includes a first blade configured to rotate about a first axis and a second blade configured to rotate about a second axis. The diffuser assembly also includes a linkage mechanism coupled to the first blade and the second blade. The linkage mechanism is adjustable between a first configuration in which the linkage mechanism is configured to synchronize rotation of the first blade about the first axis and rotation of the second blade about the second axis in a common direction, and a second configuration in which the linkage mechanism is configured to synchronize rotation of the first blade about the first axis and rotation of the second blade about the second axis in opposing directions.

The present disclosure also relates to a diffuser assembly for a heating, ventilation, and air conditioning (HVAC) system. The diffuser assembly includes a housing configured to receive an air flow and a plurality of blades pivotably coupled to the housing and configured to rotate about respective axes relative to the housing. The diffuser assembly also includes a linkage mechanism coupled to the plurality of blades, where the linkage mechanism is configured to transition between a first configuration and a second configuration. In the first configuration, the linkage mechanism is configured to induce rotation of the plurality of blades about the respective axes in a common direction in response to application of an input force to a blade of the plurality of blades. In the second configuration, the linkage mechanism is configured to induce rotation of a first subset of the plurality of blades in a first direction and induce rotation of a second subset of the plurality of blades in a second direction, opposite the first direction, in response to application of the input force.

BRIEF DESCRIPTION OF THE DRAWINGS

Various aspects of this disclosure may be better understood upon reading the following detailed description and upon reference to the drawings in which.

DETAILED DESCRIPTION

Figure 1:
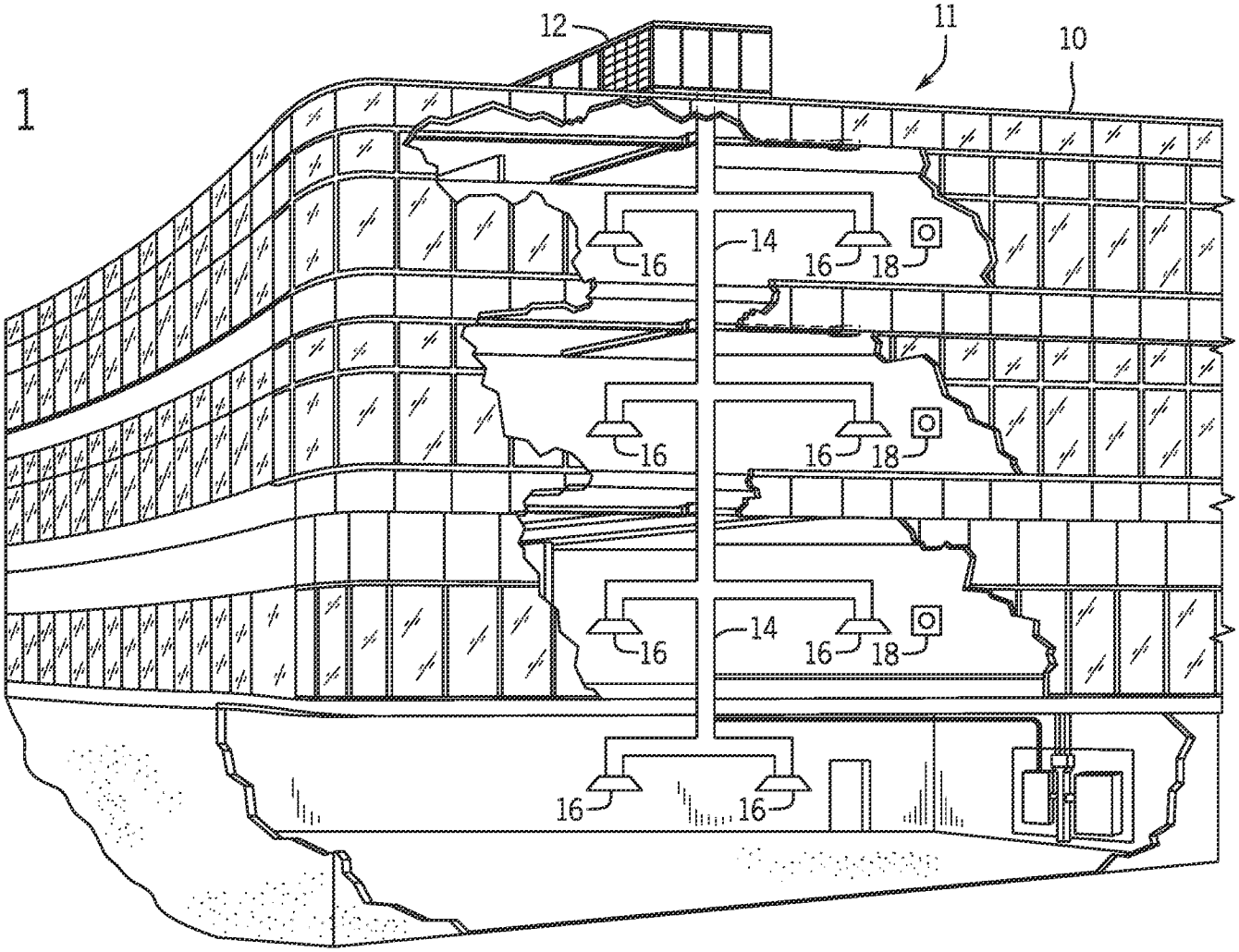
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

As briefly discussed above, a heating, ventilation, and/or air conditioning (HVAC) system may be used to thermally regulate a space within a building, home, or other suitable structure. The HVAC system may include an HVAC unit configured to condition an air flow via an evaporator, a furnace, a heating coil, a chiller system, a heat exchanger, another heat exchange system, or a combination thereof, and to provide the conditioned air flow (e.g., a heated air flow, a cooled air flow, a dehumidified air flow) to the space. For example, the HVAC unit may be fluidly coupled to the space via an air distribution system, such as a system of ductwork, that extends between the HVAC unit and the space. One or more fans or blowers of the HVAC system may be operable to direct a supply of conditioned air from the HVAC unit, through the ductwork, and into the spaces within the building.

Typically, the HVAC system includes one or more diffusers that are fluidly coupled to terminal ends of the ductwork and are configured to facilitate distribution of air from the ductwork into the rooms or spaces of the building. For example, the diffusers may be positioned adjacent to ceilings, floors, and/or walls of the rooms conditioned by the HVAC system and may be configured to discharge air from the ductwork into the rooms or other spaces. In many cases, upon installation of the diffusers in the building, it may be arduous, time consuming, and/or infeasible to adjust a direction or directions along which the diffusers direct the conditioned air received from the ductwork into the spaces of the building. In other words, adjustability of installed diffusers may be limited, restricted, or otherwise unworkable. As such, conventional diffusers may often be set or otherwise configured to discharge air in a manner that impedes effective air distribution across the spaces serviced by the HVAC system and/or reduces a comfort of occupants that may be located within the spaces. Indeed, conventional diffusers may not provide desired adjustability or configurability to enable different discharge air flow patterns or characteristics.

It is presently recognized that enabling quick and user-friendly adjustment of a particular air discharge direction or pattern, or multiple air discharge directions or patterns, of a diffuser may facilitate effective air distribution across a room or other space to be conditioned by the HVAC system in a variety of circumstances or conditions. For example, enabling directionally-adjustable air discharge from the diffuser may mitigate or substantially eliminate stratification of conditioned air within the room or space to be conditioned when the HVAC system is transitioned between different operating modes (e.g., from a cooling mode to a heating mode, and vice versa). Accordingly, embodiments of the present disclosure are directed toward a diffuser assembly that facilitates improved, rapid adjustment of one or more air discharge directions of the diffuser assembly.

For example, embodiments of the diffuser assembly disclosed herein include a housing having an inlet configured to fluidly couple to a duct of the HVAC system. The duct may receive a flow of conditioned air (e.g., heated air, cooled air, dehumidified air) from an HVAC unit, air handler, terminal unit, or other component of the HVAC system and direct the conditioned air into an interior volume of the housing. The housing includes an outlet configured to expel the conditioned air from the interior volume and to direct the conditioned air into a room or other space serviced by the diffuser assembly. The diffuser assembly includes a plurality of blades (e.g., damper blades) that may be disposed adjacent to and upstream of the outlet, with respect to a direction of the conditioned air flow through the housing. The blades are configured to pivot about corresponding pivoting axes to guide discharge of the conditioned air flow from the housing and into the space along particular directions. The blades may be mechanically coupled via a linkage mechanism that is configured to transfer pivotal motion between the blades and enable desired positioning of the blades to achieve a selected air flow discharge direction.

In a first user-selectable configuration of the linkage mechanism, the linkage mechanism may couple the blades such that, upon application of an input force to one of the blades, such as via an actuator that may be coupled a particular blade or via a user applying a force to the blade, the linkage mechanism pivots each of the blades in a common direction (e.g., a clockwise direction) about their respective pivoting axes. As such, in the first user-selectable configuration, the linkage mechanism may facilitate adjustment of an overall discharge direction (e.g., left, right) of the diffuser assembly. In a second user-selectable configuration of the linkage mechanism, the linkage mechanism may couple the blades such that, upon application of the input force to one of the blades, the linkage mechanism pivots the blades in opposite directions about their respective pivoting axes. Accordingly, in the second user-selectable configuration, the linkage mechanism may facilitate adjustment of an overall discharge pattern (e.g., vertical, generally horizontal) of the conditioned air from the diffuser assembly. As discussed herein, in this manner, the linkage mechanism enables quick and convenient adjustability of an air discharge configuration of the diffuser assembly, which may enable the diffuser assembly to improve effective air distribution in a space serviced by the diffuser assembly and enhance occupant comfort within the space. These and other features will be described below with reference to the drawings.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by an HVAC system 11 having an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. The HVAC unit 12 may provide a variety of heating and/or cooling functions, such as cooling only, heating only, cooling with electric heat, cooling with dehumidification, cooling with gas heat, or cooling with a heat pump. For example, in certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

In any case, after the HVAC unit 12 conditions the air, the air may be supplied to the building 10 via ductwork 14 (e.g., an air distribution system) extending from the HVAC unit 12 and throughout the building 10. For example, the ductwork 14 may extend to various individual floors, rooms zones, or other sections or spaces of the building 10. In the illustrated embodiment, a plurality of diffuser assemblies 16 is coupled to the ductwork 14 (e.g., distal or terminal ends of the ductwork 14). The diffuser assemblies 16 may direct the conditioned air into the various spaces of the building 10 in a manner that improves air distribution and/or air dispersion across the spaces.

In some embodiments, a control device 18, one type of which may be a thermostat, may be used to designate the temperature of the conditioned air supplied by the HVAC unit 12. The control device 18 also may be used to control the flow of air through the ductwork 14. For example, the control device 18 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of supply air, return air, and so forth. Moreover, the control device 18 may include computer systems that are integrated with or separate from other building control or monitoring systems, and even systems that are remote from the building 10.

Figure 2:
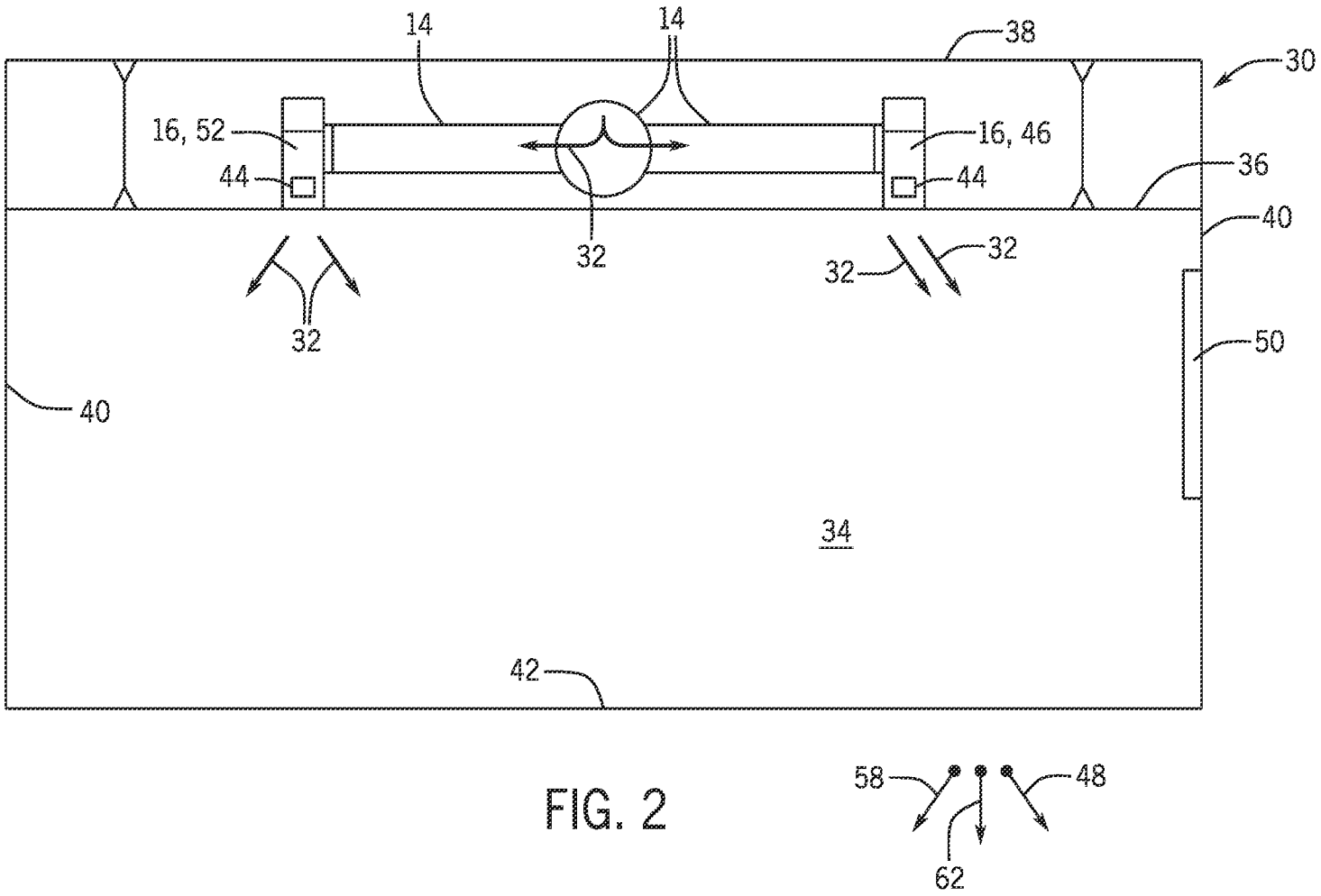
FIG. 2 is a schematic of an embodiment of a room of a building having diffuser assemblies, in accordance with an aspect of the present disclosure.

FIG. 2 is a schematic of an embodiment of a room 30 of the building 10, illustrating diffuser assemblies 16 coupled to ductwork 14. The diffuser assemblies 16 may be fluidly coupled to the ductwork 14 (e.g., to terminal ends of the ductwork 14) to receive a flow of conditioned air 32, which may generated by the HVAC unit 12, for example. The diffuser assemblies 16 are also fluidly coupled to the room 30 and are exposed to a space 34 of the room 30. Accordingly, the diffuser assemblies 16 may discharge the conditioned air 32 into the space 34 of the room 30. In some embodiments, the building 10 may include a dropped ceiling 36 (e.g., ceiling tiles) that may be suspended from a ceiling structure 38 of the building 10. At least a portion of the ductwork 14 and the diffuser assemblies 16 may be located in a space formed between the ceiling structure 38 and the dropped ceiling 36. In other embodiments, the ductwork 14 and/or the diffuser assemblies 16 may be located in any other suitable region of the building 10. For example, the ductwork 14, the diffuser assemblies 16, or both, may be partially or fully integrated into the ceiling structure 38 of the building 10 and/or located in walls 40 or a floor 42 of the building 10.

As discussed in detail herein, each of the diffuser assemblies 16 may include a plurality of blades 44 that is configured to adjust a discharge direction and/or discharge pattern (e.g., a discharge configuration having multiple discharge directions) of the conditioned air 32 directed into the space 34. For example, in some embodiments, the blades 44 of a first diffuser assembly 46 may be oriented along a common direction to direct the conditioned air 32 into the space 34 along a first direction 48. As such, the first diffuser assembly 46 may direct the conditioned air 32 toward a window 50 or other structure (e.g., one of the walls 40) of the room 30, for example. Alternatively, the blades 44 of a second diffuser assembly 52 may be oriented along opposing directions with respect to one another, such that the blades 44 of the second diffuser assembly 52 may direct a portion of the conditioned air 32 discharged from the second diffuser assembly 52 along the first direction 48 and direct a remaining portion of the conditioned air 32 discharged from the second diffuser assembly 52 along a second direction 58, which may extend crosswise to the first direction 48. As such, in the illustrated embodiment, the second diffuser assembly 52 may have a more lateral discharge pattern (e.g., a discharge configuration having generally lateral air discharge directions) with respect to the floor 42 of the room 30, for example. Further, in certain embodiments, the blades 44 of either or both of the diffuser assemblies 16 may be positioned to discharge the conditioned air 32 generally along a vertical direction 62 (e.g., a direction of gravity) toward the floor 42. As such, it should be appreciated that the blades 44 of each of the diffuser assemblies 16 may be adjusted to a variety of positions to facilitate distribution of the conditioned air 32 throughout the space 34 in a manner (e.g., a pattern) that facilitates conditioning of the space 34 and improves a comfort of occupants that may be located within the room 30. As discussed in detail herein, the diffuser assemblies 16 may each include a linkage mechanism that is coupled to the blades 44 to facilitate adjustment of the diffuser assemblies 16 between any of the aforementioned air discharge configurations, amongst others.

Figure 3:
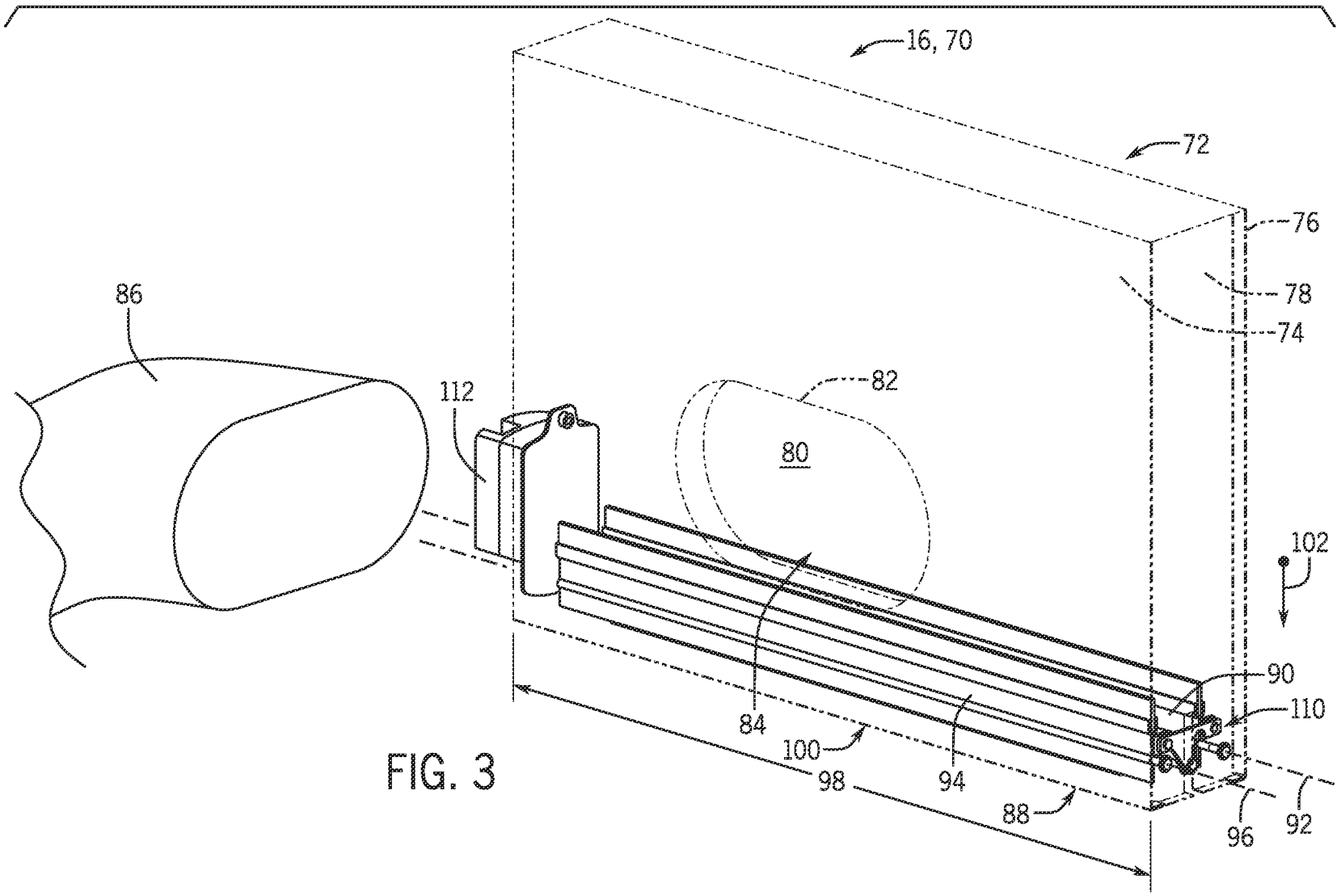
FIG. 3 is a perspective view of an embodiment of a diffuser assembly, in accordance with an aspect of the present disclosure.

FIG. 3 is a perspective view of an embodiment of one of the diffuser assemblies 16, referred to herein as a diffuser assembly 70 (e.g., an adjustable diffuser assembly). In the illustrated embodiment, the diffuser assembly 70 includes a housing 72 having a first wall 74 (e.g., a front wall, a first or second wall), a second wall 76 (e.g., a rear wall, a first or second wall), and a web 78 (e.g., lateral wall, lateral sides, wrap, etc.) that extends between (e.g., from and to) the first wall 74 and the second wall 76. The first wall 74, the second wall 76, and the web 78 may collectively define an interior volume 80 of the diffuser assembly 70. In the illustrated embodiment, the first wall 74 includes a wall flange 82 extending therefrom, which may define a passage 84 extending through the first wall 74 and into the interior volume 80 of the housing 72. The wall flange 82 may be configured to receive, engage with, or otherwise couple to (e.g., mechanically couple to, fluidly couple to) at duct 86 (e.g., a flexible duct, a duct end, a duct outlet) of the ductwork 14. Accordingly, the duct 86 may direct a conditioned air flow (e.g., a cooled air flow, a heated air flow, a dehumidified air flow) that may be generated by the HVAC unit 12, for example, through the passage 84 and into the interior volume 80 of the housing 72. The housing 72 may discharge the conditioned air flow received from the duct 86 via an outlet 88 of the housing 72, which may be formed between the first wall 74, the second wall 76, and the web 78.

In the illustrated embodiment, the diffuser assembly 70 includes a first blade 90 that may be pivotably coupled to the housing 72 and configured to pivot about a first axis 92 with respect to the housing 72. The diffuser assembly 70 also includes a second blade 94 that may be pivotably coupled to the housing 72 and configured to pivot about a second axis 96 with respect to the housing 72. The first axis 92 and the second axis 96 may extend generally parallel to one another and generally parallel to a width 98 of the housing 72. The first blade 90 and the second blade 94 may collectively be referred to herein as blades 100 of the diffuser assembly 70. Although the illustrated embodiment of the diffuser assembly 70 includes two blades 100, it should be understood that the diffuser assembly 70 may include 2, 3, 4, 5, 6, or more than 6 blades, as various embodiments of the diffuser assembly 70 are envisioned and may incorporate the presently disclosed techniques.

The blades 100 may be positioned adjacent to the outlet 88 and upstream of the outlet 88, with respect to a flow direction 102 of the conditioned air through the housing 72. In certain embodiments, at least a portion of the blades 100 may protrude downstream beyond the outlet 88, with respect to the flow direction 102. In any case, as discussed in detail below, the blades 100 may be configured to pivot between a plurality of blade positions, relative to one another and/or relative to the housing 72, to adjust a discharge configuration of the diffuser assembly 70. As used herein, a "discharge configuration" of the diffuser assembly 70 may refer to a direction or combination of directions at which the diffuser assembly 70 is configured to discharge air from the outlet 88 and into a space (e.g., the space 34) serviced by the diffuser assembly 70, and/or a distance (e.g., throw) at which the diffuser assembly 70 forces the air into the space 34. The blades 100 are coupled to a linkage mechanism 110 that is configured to guide and facilitate adjustment of the blades 100 between the plurality of blade positions.

In some embodiments, at least one of the blades 100 (e.g., the first blade 90) may be directly or indirectly coupled to an actuator 112 that is configured to drive rotation (e.g., pivotal movement) of the blades 100 about the corresponding axes 92, 96. For example, in an embodiment, the actuator 112 may be coupled to the first blade 90 and configured to drive movement (e.g., rotation) of the first blade 90 about the first axis 92. As discussed in detail herein, the linkage mechanism 110 may be configured to impart movement (e.g., transfer force) from the first blade 90 to the second blade 94 (e.g., to effectuate pivotal movement of the second blade 94 about the second axis 96). As such, cooperation between the actuator 112 and the linkage mechanism 110 enables actuation of both the first blade 90 and the second blade 94 about the first axis 92 and the second axis 96, respectively. In other embodiments, the actuator 112 may be omitted from the diffuser assembly 70. In such embodiments, adjustment of the blades 100 may occur via an input force provided by a user (e.g., an occupant of the space 34) to the first blade 90 or the second blade 94. For example, the user may access the first blade 90 or to the second blade 94 (e.g., via the outlet 88) to manually pivot the first blade 90 or the second blade 94 about the corresponding axis 92, 96. Regardless, due to the coupling of the linkage mechanism 110 to the first blade 90 and the second blade 94, the linkage mechanism 110 may impart movement from the first blade 90 to the second blade 94 or from the second blade 94 to the first blade 90. That is, as discussed below, the user may apply the input force to the first blade 90 or the second blade 94 to cause rotation of both of the blades 100 about the corresponding axes 92, 96.

Figure 4:
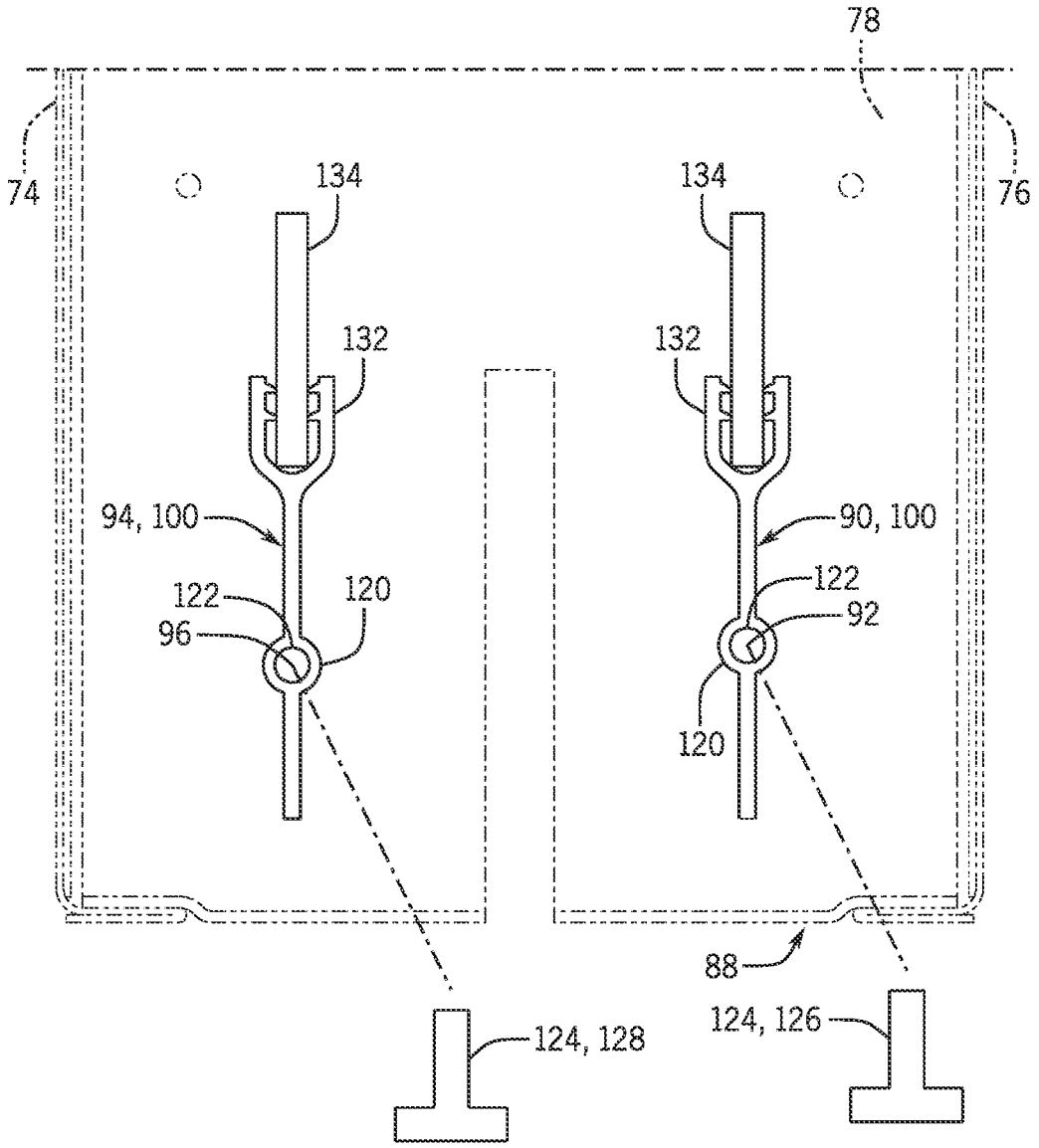
FIG. 4 is a side view of an embodiment of a portion of a diffuser assembly, in accordance with an aspect of the present disclosure.

FIG. 4 is a side view of an embodiment of a portion of the diffuser assembly 70, illustrating the first blade 90 and the second blade 94. The blades 100 may each include a channel 120 or a plurality of channels (e.g., a pair of channels) formed therein. The web 78 of the housing 72 may include a set of apertures 122 formed therein. One or more pins 124 (e.g., bolts) may be configured to extend through each set of the apertures 122 and the channels 120 to pivotably couple the first blade 90 and the second blade 94 to the housing 72. That is, in some embodiments, the pins 124 may include a first pin 126 configured to extend along the first axis 92 to pivotably couple the first blade 90 to the housing 72 and include a second pin 128 configured to extend along the second axis 96 to pivotably couple the second blade 94 to the housing 72. In certain embodiments, the pins 126, 128 and the corresponding blades 90, 94 may collectively rotate about the axes 92, 96 relative to the housing 72. In other embodiments, the first blade 90 may be configured to rotate about the first pin 126 and the first axis 92, relative to the first pin 126 and the housing 72, and the second blade 94 may be configured to rotate about the second pin 128 and the second axis 96, relative to the second pin 128 and the housing 72.

In some embodiments, either or both of the blades 100 may include a blade holder 132 configured to support a blade piece 134. For example, the blade holders 132 may be configured to receive and apply a compressive force to the blade pieces 134 to retain the blade pieces 134 in the blade holder 132. The blade pieces 134 may include a rigid material or a pliable material (e.g., a polymeric material, such as rubber). As discussed below, the blade pieces 134 may be configured to guide air flow through the housing 72 and out of the outlet 88 while the blades 100 are oriented in various configurations in the housing 72. For clarity, it should be understood that the blade pieces 134 may form a portion of the blades 100 themselves.

Figure 5:
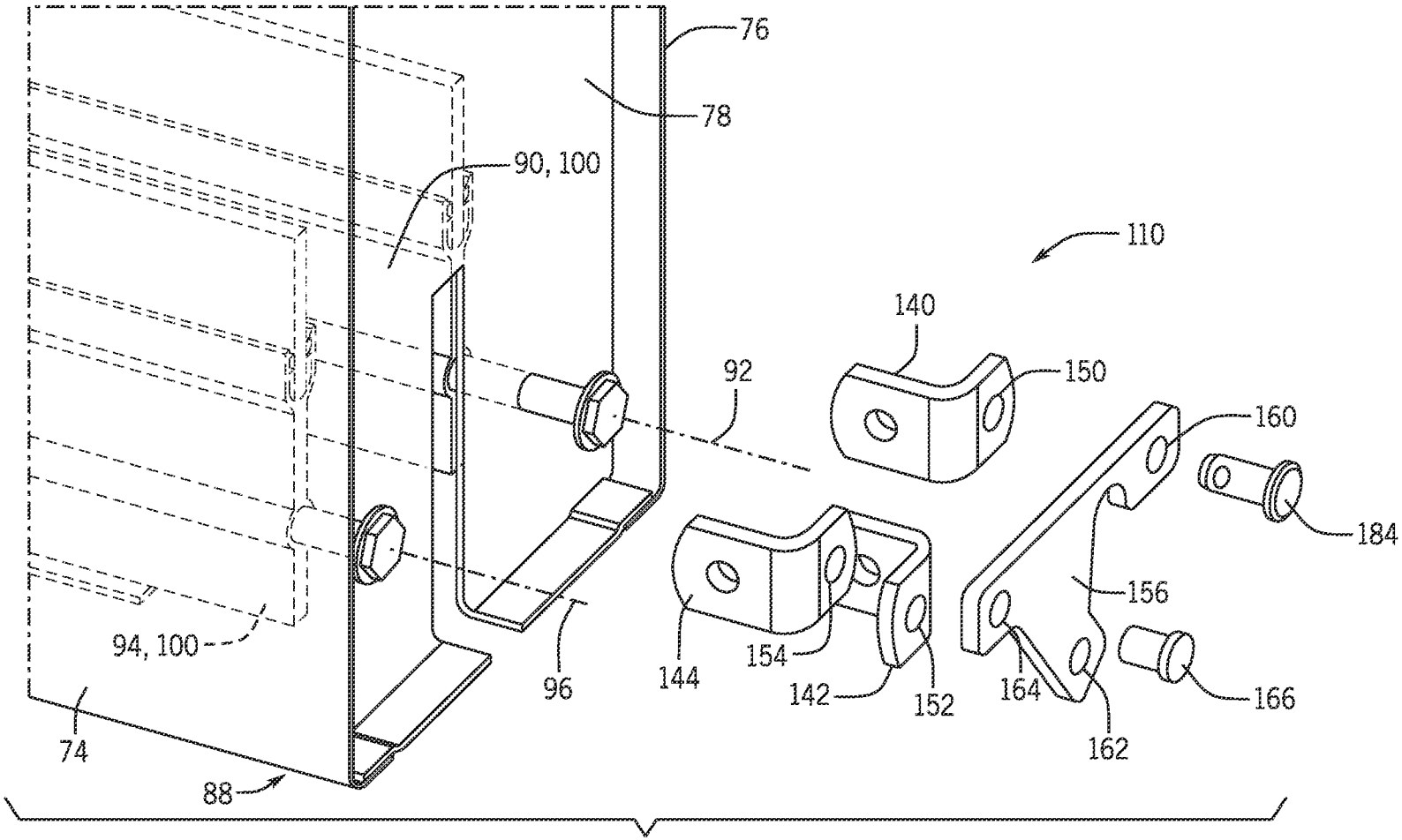
FIG. 5 is a partial exploded perspective view of an embodiment of a portion of a diffuser assembly, in accordance with an aspect of the present disclosure.
Figure 6:
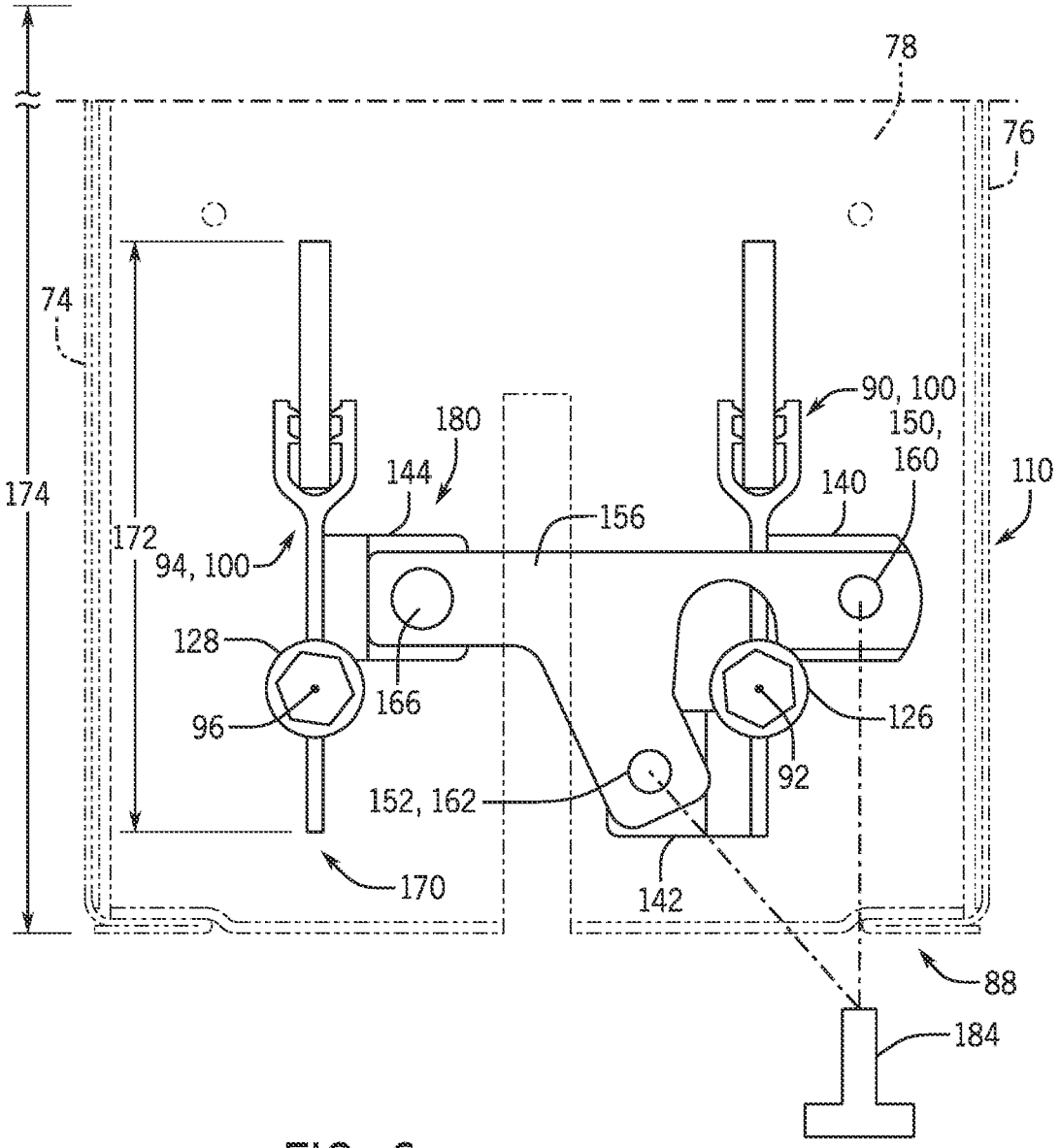
FIG. 6 is a side view of an embodiment of a portion of a diffuser assembly, in accordance with an aspect of the present disclosure.

FIG. 5 is a partial exploded perspective view of an embodiment of the diffuser assembly 70, illustrating the linkage mechanism 110 in a disassembled configuration. FIG. 6 is a side view of an embodiment of a portion of the diffuser assembly 70, illustrating the linkage mechanism 110 in an assembled configuration. FIGS. 5 and 6 will be discussed concurrently throughout the following discussion. In some embodiments, the linkage mechanism 110 includes a first bracket 140 and a second bracket 142 that may each be configured to couple to the first blade 90. In particular, the first bracket 140 may be configured to couple to a first outer surface of the first blade 90 (e.g., a surface of the first blade 90 facing the second wall 76), and the second bracket 142 may be configured to couple to a first inner surface of the first blade 90 (e.g., a surface of the first blade 90 facing the first wall 74). In other embodiments, the first and second brackets 140, 142 may be configured to couple to any other suitable portion of the first blade 90 that enables operation of the linkage mechanism 110 in accordance with the techniques discussed herein.

The linkage mechanism 110 may also include a pin bracket 144 that may be configured to couple to an inner surface the second blade 94 (e.g., a surface of the second blade 94 facing the second wall 76). The first bracket 140, the second bracket 142, and the pin bracket 144 may be configured to couple (e.g., fixedly couple) to the corresponding blades 100 via fasteners, adhesives, or a metallurgical process, such as welding or brazing. In any case, the first bracket 140 may include a first bracket aperture 150 formed therein, the second bracket 142 may include a second bracket aperture 152 formed therein, and the pin bracket 144 may include a third bracket aperture 154 formed therein. As discussed below, the first, second, and pin brackets 140, 142, 144 may facilitate coupling (e.g., mechanical linking, pivotable coupling) of the first blade 90 and the second blade 94 via an intermediate bracket 156 of the linkage mechanism 110. In some embodiments, the first bracket 140 and/or the second bracket 142 may be formed integrally with (e.g., extend from) a body of the first blade 90, the pin bracket 144 may be formed integrally with (e.g., extend from) a body of the second blade 94, or both.

As shown in the illustrated embodiment of FIG. 5, the intermediate bracket 156 may include a first intermediate aperture 160, a second intermediate aperture 162, and a third intermediate aperture 164 formed therein. The linkage mechanism 110 includes a pivot pin 166 that is configured to extend through the third intermediate aperture 164 and the third bracket aperture 154 to pivotably couple the intermediate bracket 156 to the pin bracket 144. For example, in the illustrated embodiment of FIG. 6, the intermediate bracket 156 is shown in an installed configuration with the pin bracket 144, whereby the pivot pin 166 pivotably couples the intermediate bracket 156 to the pin bracket 144.

Moreover, in the illustrated embodiment of FIG. 6, the blades 100 are shown in a neutral configuration 170, in which a length 172 of each of the blades 100 may extend generally along a height 174 of the housing 72. In some embodiments, while the blades 100 are in the neutral configuration 170, and while the intermediate bracket 156 is in the installed configuration with the pin bracket 144, the first intermediate aperture 160 of the intermediate bracket 156 may be aligned with the first bracket aperture 150 of the first bracket 140, and the second intermediate aperture 162 of the intermediate bracket 156 may be aligned with the second bracket aperture 152 of the second bracket 142. This configuration will be referred to herein as a "selection configuration 180" of the linkage mechanism 110. That is, in the selection configuration 180 of the linkage mechanism 110, the intermediate bracket 156 may be pivotably coupled to the pin bracket 144 via the pivot pin 166, the first intermediate aperture 160 of the intermediate bracket 156 may be aligned with the first bracket aperture 150 of the first bracket 140, and the second intermediate aperture 162 of the intermediate bracket 156 may be aligned with the second bracket aperture 152 of the second bracket 142.

The diffuser assembly 70 further includes a selection pin 184 (e.g., a self-locking implanted cotter [SLIC] pin, a bolt, a dowel pin, a removable selection pin) that may be configured to selectively couple the intermediate bracket 156 to the first bracket 140 or to selectively couple the intermediate bracket 156 to the second bracket 142. For example, to transition the linkage mechanism 110 to a first adjustment configuration 190 (see FIG. 8), a user may extend the selection pin 184 through the first intermediate aperture 160 and the first bracket aperture 150 to pivotably couple the intermediate bracket 156 to the first bracket 140. That is, in the first adjustment configuration 190 of the linkage mechanism 110, the intermediate bracket 156 may be pivotably coupled to the pin bracket 144 mounted to the second blade 94 and to the first bracket 140 mounted to the first blade 90. To transition the linkage mechanism 110 to a second adjustment configuration 192 (see FIG. 7), a user may extend the selection pin 184 through the second intermediate aperture 162 and the second bracket aperture 152 to pivotably couple the intermediate bracket 156 to the second bracket 142. That is, in the second adjustment configuration 192 of the linkage mechanism 110, the intermediate bracket 156 may be pivotably coupled to the pin bracket 144 mounted to the second blade 94 and to the second bracket 142 mounted to the first blade 90. It should be appreciated that, while the linkage mechanism 110 is in the selection configuration 180, the user may quickly and easily transition the linkage mechanism 110 to the first adjustment configuration 190 or the second adjustment configuration 192 by repositioning the selection pin 184 in the manner described above. As discussed below, by transitioning the linkage mechanism 110 between the first adjustment configuration 190 and the second adjustment configuration 192, the user may enable the linkage mechanism 110 to control adjustment of the blades 100 in various manners (e.g., discharge configurations) that permit different patterns of air discharge from the outlet 88 of the diffuser assembly 70.

Figure 7:
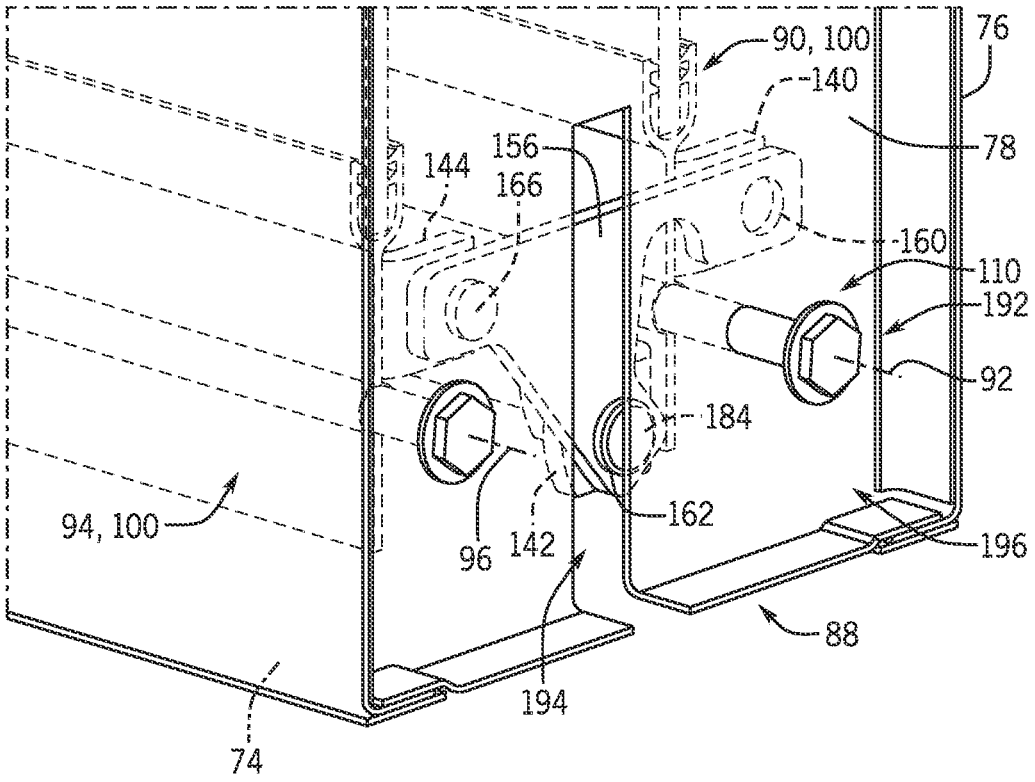
FIG. 7 is a perspective view of an embodiment of a portion of a diffuser assembly, in accordance with an aspect of the present disclosure.

FIG. 7 is a perspective view of an embodiment of a portion of the diffuser assembly 70, illustrating the linkage mechanism 110 in the second adjustment configuration 192, in which the selection pin 184 pivotably couples the intermediate bracket 156 to the second bracket 142. To transition the linkage mechanism 110 from the second adjustment configuration 192 to the first adjustment configuration 190, the user may remove the selection pin 184 from the second intermediate aperture 162 of the intermediate bracket 156 and from the second bracket aperture 152 of the second bracket 142, and the user may insert the selection pin 184 in the first intermediate aperture 160 of the intermediate bracket 156 and the first bracket aperture 150 of the first bracket 140 to pivotably couple the intermediate bracket 156 to the first bracket 140. In some embodiments, the user may access the selection pin 184 via the outlet 88 of the diffuser assembly 70 to install the selection pin 184 with or remove the selection pin 184 from the linkage mechanism 110. In certain embodiments, the web 78 may include an opening 194 that is sufficiently sized to enable a user to manipulate the selection pin 184 from a side 196 of the diffuser assembly 70. Additionally or alternatively, the web 78 may include a removable panel or door coupled thereto, which may be actuatable by the user to selectively enable or occlude access to the linkage mechanism 110 and the selection pin 184.

Figure 8:
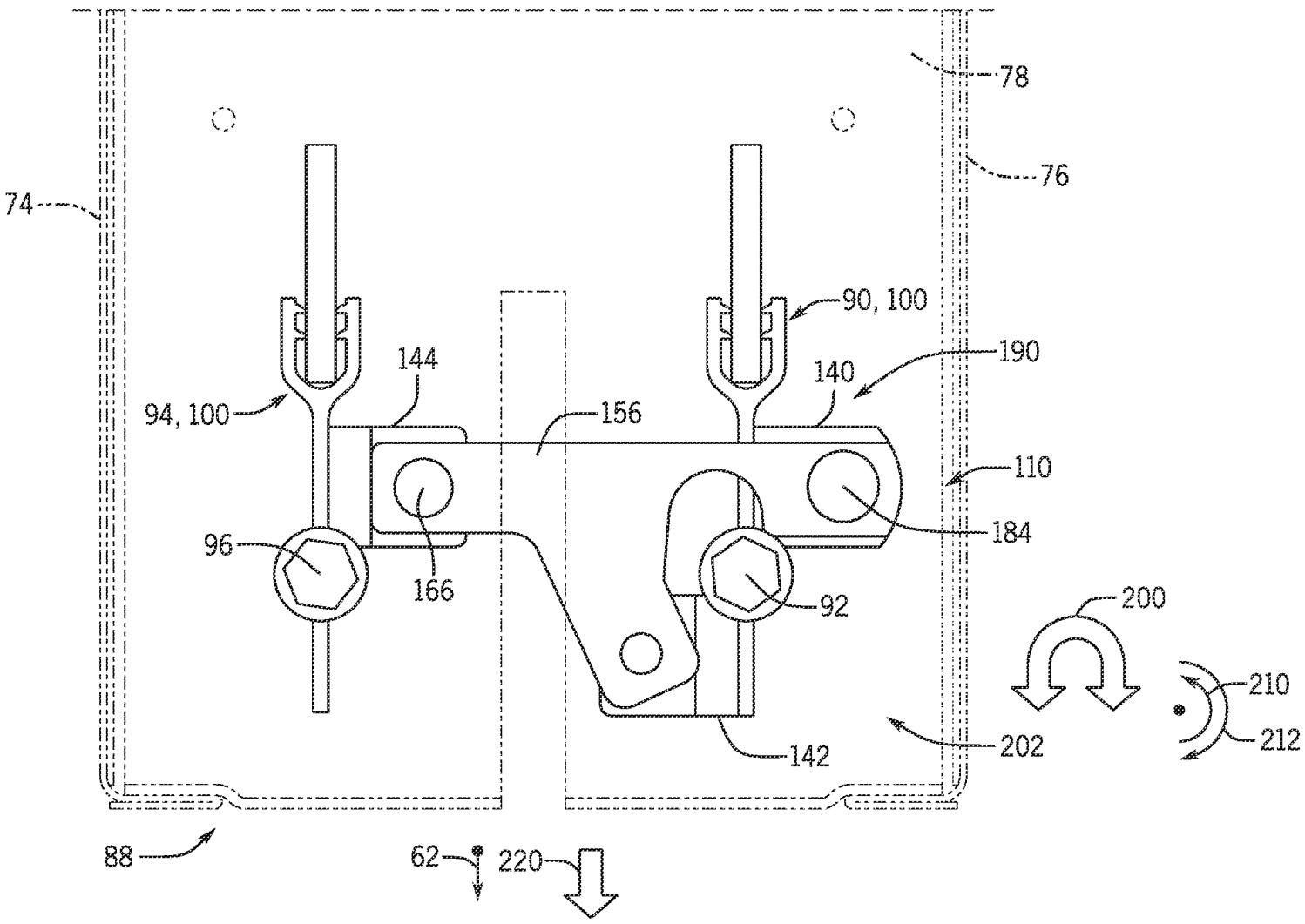
FIG. 8 is a side view of an embodiment of a portion of a diffuser assembly, in accordance with an aspect of the present disclosure.

FIG. 8 is a side view of an embodiment of a portion of the diffuser assembly 70, illustrating the linkage mechanism 110 in the first adjustment configuration 190, in which the selection pin 184 pivotably couples the intermediate bracket 156 to the first bracket 140. The following discussion will proceed with reference to an "input force 200" applied to the diffuser assembly 70. For clarity, the input force 200 may be indicative of a force applied by the actuator 112 to the first blade 90 to drive rotation of the first blade 90 about the first axis 92, a force applied by the actuator 112 to the second blade 94 to drive rotation of the second blade 94 about the second axis 96, a force applied by a user (e.g., a human operator applying a physical force) to the first blade 90 to drive rotation of the first blade 90 about the first axis 92, a force applied by the user to the second blade 94 to drive rotation of the second blade 94 about the second axis 96, or any combination thereof. That is, the input force 200 may be any suitable force applied to the first blade 90 to drive rotation of the first blade 90 about the first axis 92, applied to the second blade 94 to drive rotation of the second blade 94 about the second axis 96 (e.g., via an actuator or a human operator), or both.

In the illustrated embodiment of FIG. 8, the blades 100 are shown in a neutral discharge configuration 202, in which the blades 100 may extend generally parallel to one another and generally along the first wall 74 and/or the second wall 76 of the housing 72. As such, the blades 100 may facilitate discharge of conditioned air 220 through the outlet 88 along the vertical direction 62 (e.g., when the diffuser assembly 70 is installed in the dropped ceiling 36). In the first adjustment configuration 190, the linkage mechanism 110 may, in response to rotation of the first blade 90 about the first axis 92 in a counter-clockwise direction 210 (e.g., due to application of the input force 200 on the first blade 90), induce rotation of the second blade 94 about the second axis 96 in the counter-clockwise direction 210. In other words, the linkage mechanism 110 may transfer the input force 200 from the first blade 90 to the second blade 94. Further, in the first adjustment configuration 190, the linkage mechanism 110 may, in response to rotation of the first blade 90 about the first axis 92 in a clockwise direction 212 (e.g., due to application of the input force 200 on the first blade 90), induce rotation of the second blade 94 about the second axis 96 in the clockwise direction 212 by transferring the input force 200 from the first blade 90 to the second blade 94.

Figure 9:
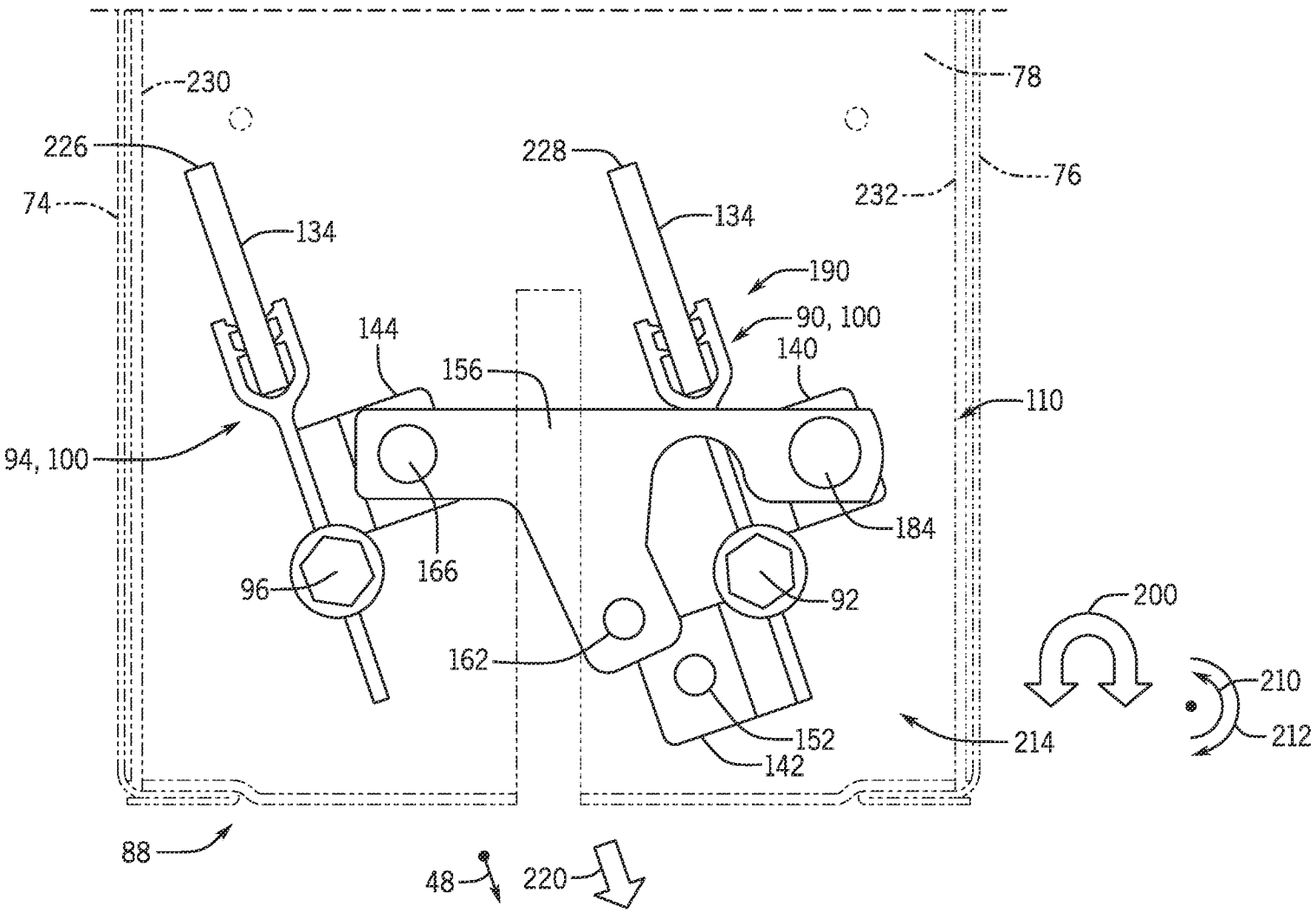
FIG. 9 is a side view of an embodiment of a portion of a diffuser assembly, in accordance with an aspect of the present disclosure.
Figure 10:
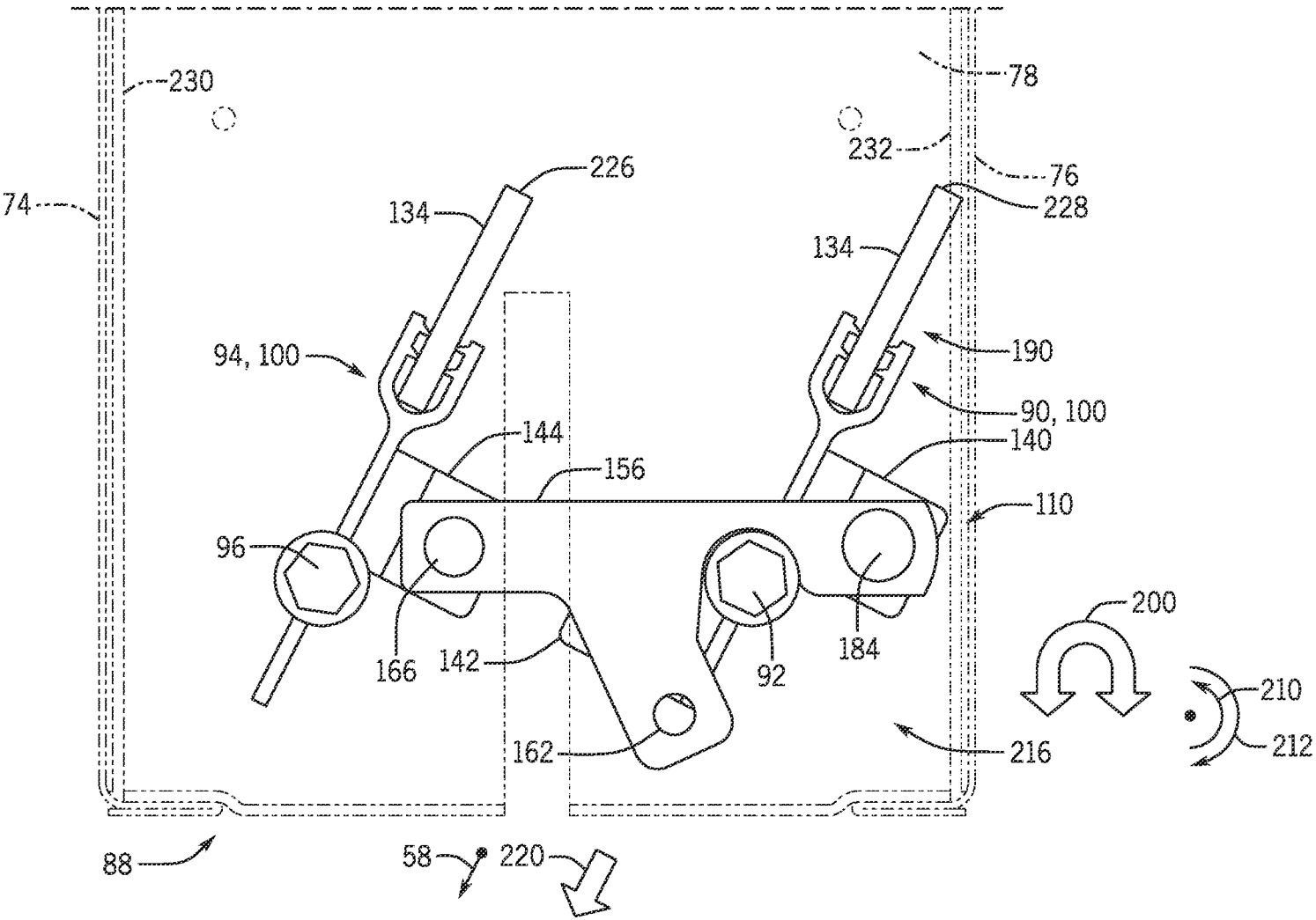
FIG. 10 is a side view of an embodiment of a portion of a diffuser assembly, in accordance with an aspect of the present disclosure.

For example, FIG. 9 is a side view of an embodiment of a portion of the diffuser assembly 70, illustrating the blades 100 in a first discharge configuration 214, in which the blades 100 have been rotated in the counter-clockwise direction 210 about the axes 92, 96, with respect to the neutral discharge configuration 202 of the blades 100 shown in FIG. 8. FIG. 10 is a side view of an embodiment of a portion of the diffuser assembly 70, illustrating the blades 100 in a second discharge configuration 216, in which the blades 100 have been rotated in the clockwise direction 212 about the axes 92, 96, with respect to the neutral discharge configuration 202 of the blades 100 shown in FIG. 8. FIGS. 9 and 10 will be discussed concurrently below.

To transition the blades 100 from the neutral discharge configuration 202 to the first discharge configuration 214, the input force 200 may be applied to the first blade 90, for example, to rotate the first blade 90 about the first axis 92 in the counter-clockwise direction 210, and to therefore enable the intermediate bracket 156 to cause rotation of the second blade 94 about the second axis 96 in the counter-clockwise direction 210. As such, in the first discharge configuration 214, the blades 100 may guide discharge of substantially all of the conditioned air 220 received by the diffuser assembly 70 (e.g., via the duct 86) through the outlet 88 along the first direction 48. To transition the blades 100 from the first discharge configuration 214 to the second discharge configuration 216, the input force 200 may be applied to the first blade 90, for example, to rotate the first blade 90 about the first axis 92 in the clockwise direction 212, and to therefore enable the intermediate bracket 156 to cause rotation of the second blade 94 about the second axis 96 in the clockwise direction 212. As such, in the second discharge configuration 216, the blades 100 may guide discharge of substantially all of the conditioned air 220 received by the diffuser assembly 70 through the outlet 88 along the second direction 58.

In some embodiments, in the first adjustment configuration 190, the linkage mechanism 110 may be configured such that a particular degree of rotation of the first blade 90 about the first axis 92 induces a corresponding (e.g., substantially equal) degree of rotation of the second blade 94 about the second axis 96, and vice versa. That is, in the first adjustment configuration 190, the linkage mechanism 110 may coordinate (e.g., synchronize) and enable rotation of each of the blades 100 about the respective axes 92, 96 in a common (e.g., same) direction. Moreover, it should be appreciated that the blades 100 may be transitioned to any suitable position (e.g., angular orientation) between the first discharge configuration 214 and the second discharge configuration 216 described above.

In some embodiments, in the first discharge configuration 214, the blade piece 134 of the second blade 94 (e.g., an upstream end portion 226 of the blade piece 134 of the second blade 94) may be configured to engage with an inner surface 230 of the first wall 74 to form a fluid seal at an interface between the second blade 94 and the first wall 74. In the second discharge configuration 216, the blade piece 134 of the first blade 90 (e.g., an upstream end portion 228 of the blade piece 134 of the first blade 90) may be configured to engage with an additional inner surface 232 of the second wall 76 to form a fluid seal at an interface between the first blade 90 and the second wall 76. In this way, the blade pieces 134 may facilitate improved discharge of the conditioned air 220 in the first direction 48 or the second direction 58 when the blades 100 are in the first discharge configuration 214 or the second discharge configuration 216, respectively.

Figure 11:
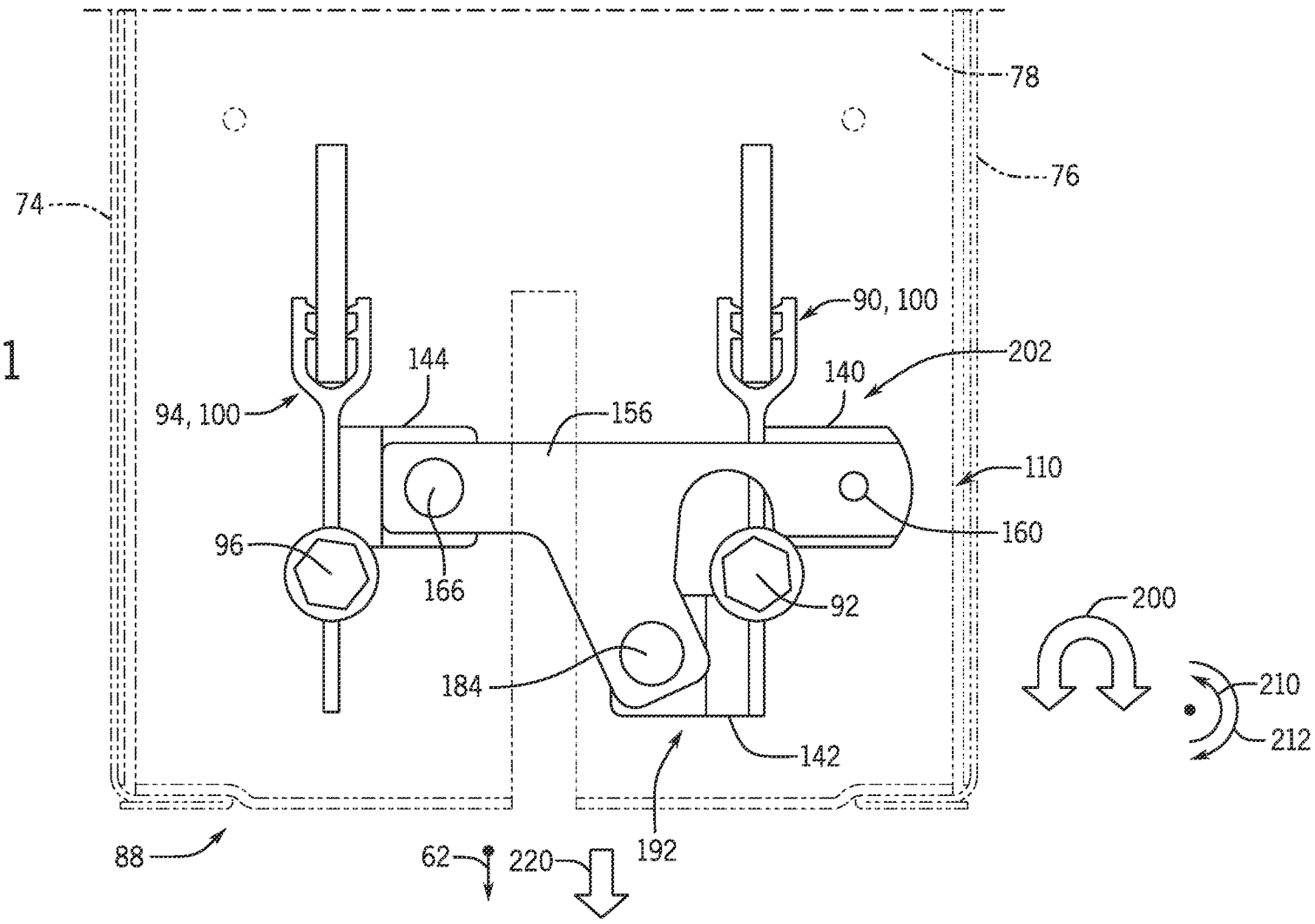
FIG. 11 is a side view of an embodiment of a portion of a diffuser assembly, in accordance with an aspect of the present disclosure.

FIG. 11 is a side view of an embodiment of a portion of the diffuser assembly 70, illustrating the linkage mechanism 110 in the second adjustment configuration 192, in which the selection pin 184 pivotably couples the intermediate bracket 156 to the second bracket 142. In the illustrated embodiment, the blades 100 are shown in the neutral discharge configuration 202, in which the blades 100 may facilitate discharge of conditioned air 220 through the outlet 88 along the vertical direction 62 (e.g., when the diffuser assembly 70 is installed in the dropped ceiling 36).

In the second adjustment configuration 192, the linkage mechanism 110 may, in response to rotation of the first blade 90 about the first axis 92 in the counter-clockwise direction 210 (e.g., due to application of the input force 200 on the first blade 90), induce rotation of the second blade 94 about the second axis 96 in the clockwise direction 212. Moreover, in the second adjustment configuration 192, the linkage mechanism 110 may, in response to rotation of the first blade 90 about the first axis 92 in the clockwise direction 212 (e.g., due to application of the input force 200 on the first blade 90), induce rotation of the second blade 94 about the second axis 96 in the counter-clockwise direction 210.

Figure 12:
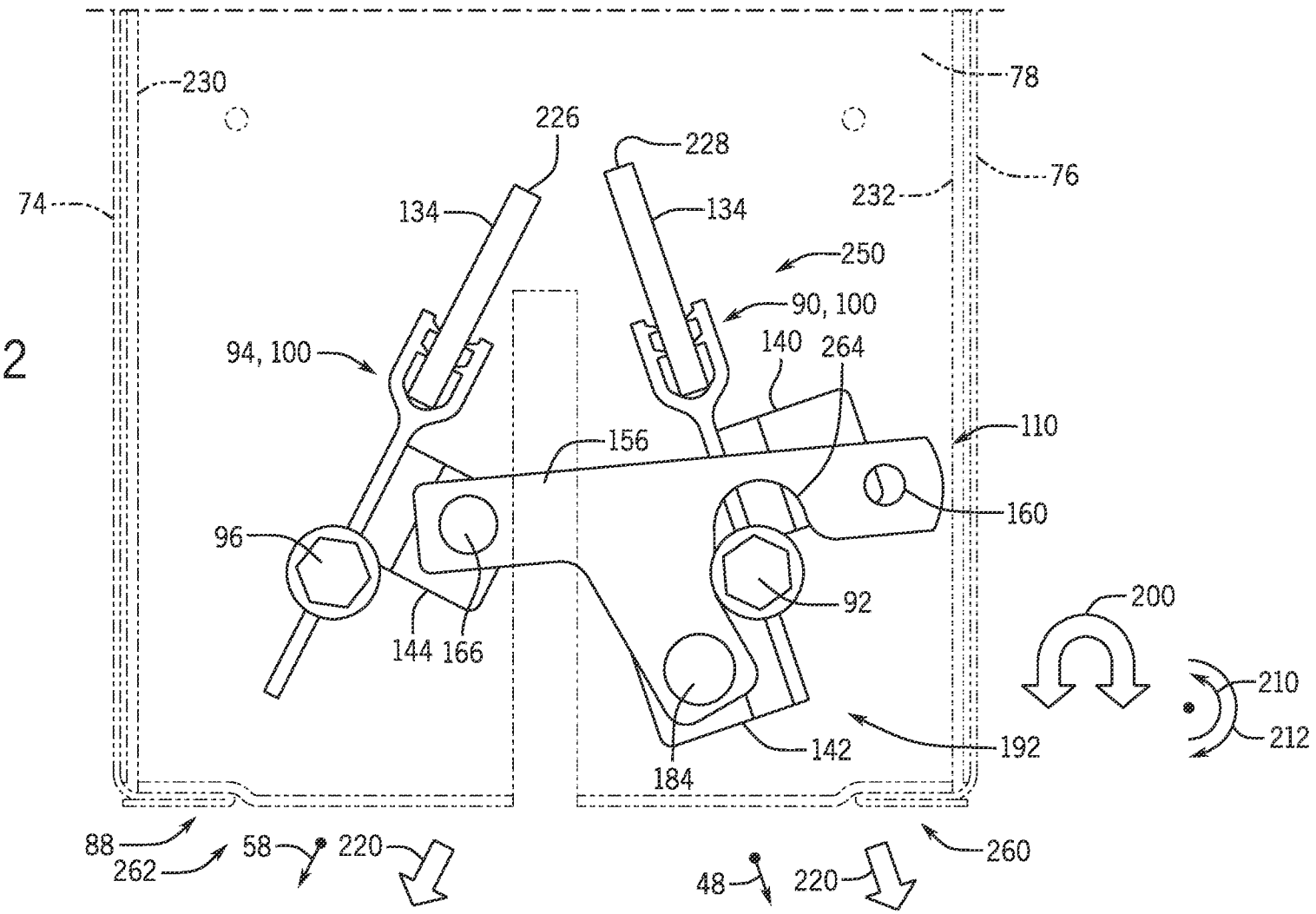
FIG. 12 is a side view of an embodiment of a portion of a diffuser assembly, in accordance with an aspect of the present disclosure.
Figure 13:
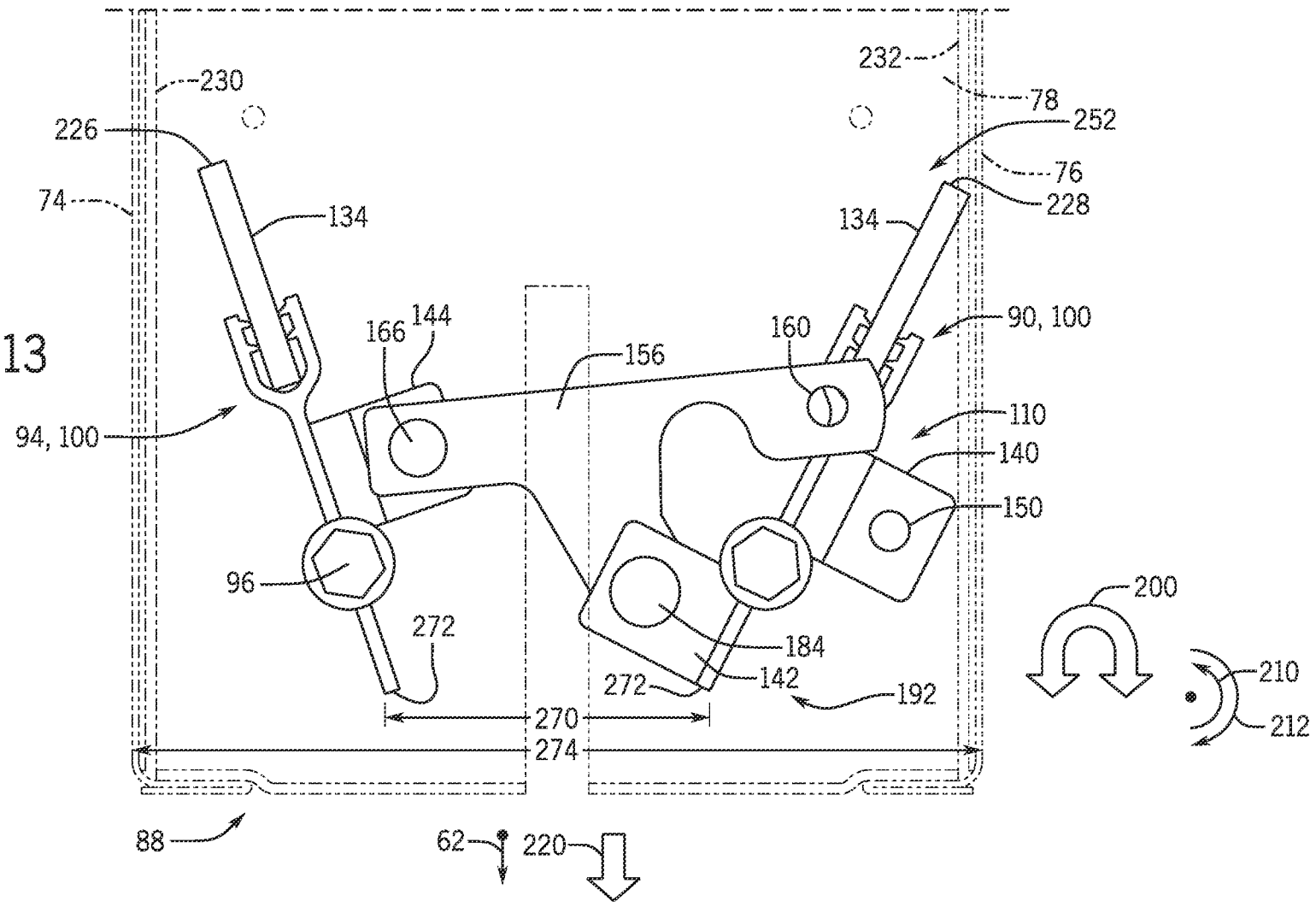
FIG. 13 is a side view of an embodiment of a portion of a diffuser assembly, in accordance with an aspect of the present disclosure.

To better illustrate the actuation of the blades 100 while the linkage mechanism 110 is in the second adjustment configuration 192 and to facilitate the following discussion, FIG. 12 is a side view of an embodiment of a portion of the diffuser assembly 70, illustrating the blades 100 in a third discharge configuration 250. FIG. 13 is a side view of an embodiment of a portion of the diffuser assembly 70, illustrating the blades 100 in a fourth discharge configuration 252. FIGS. 11 and 12 will be discussed concurrently below. To transition the blades 100 from the neutral discharge configuration 202 to the third discharge configuration 250, the input force 200 may be applied to the first blade 90, for example, to rotate the first blade 90 about the first axis 92 in the counter-clockwise direction 210, and to therefore enable the intermediate bracket 156 to cause rotation the second blade 94 about the second axis 96 in the clockwise direction 212. As such, in the third discharge configuration 250, the blades 100 may guide discharge of the conditioned air 220 through the outlet 88 along both the first direction 48 and second direction 58. That is, in the third discharge configuration 250, the blades 100 may guide discharge of a first portion of the conditioned air 220 along the first direction 48 and guide discharge of a second portion (e.g., a remaining portion) of the conditioned air 220 along the second direction 58.

In certain embodiments, in the third discharge configuration 250 of the blades 100, the blade pieces 134 (e.g., the upstream end portions 226, 228) may be configured to engage one another to form a fluid seal at an interface between the first blade 90 and the second blade 94. In this way, the blade pieces 134 may facilitate separation of the conditioned air 220 within the housing 72 into a first air flow that is directed through a first portion 260 of the outlet 88 between the first blade 90 and the second wall 76 and a second air flow that is directed through a second portion 262 of the outlet 88 between the second blade 94 and the first wall 74. In some embodiments, the intermediate bracket 156 may include a notch 264 formed therein that enables avoidance of interference between the intermediate bracket 156 and the first pin 126 while the linkage mechanism 110 is in the third discharge configuration 250 or in other configurations disclosed herein.

To transition the blades 100 from the third discharge configuration 250 to the fourth discharge configuration 252, the input force 200 may be applied to the first blade 90, for example, to rotate the first blade 90 about the first axis 92 in the clockwise direction 212, and to therefore enable the intermediate bracket 156 to cause rotation of the second blade 94 about the second axis 96 in the counter-clockwise direction 210. As such, in the fourth discharge configuration 252, the blades 100 may guide discharge of the conditioned air 220 through the outlet 88 along the vertical direction 62.

In certain embodiments, in the fourth discharge configuration 252, the blades 100 may reduce an effective cross-sectional area of the outlet 88, as compared to a normal cross-sectional area of the outlet 88, such as when the blades 100 are in the neutral discharge configuration 202. For example, in the fourth discharge configuration 252, the blade piece 134 of the first blade 90 may engage with (e.g., at the upstream end portion 228 to form fluidic seal with) the additional inner surface 232 of the second wall 76, and the blade piece 134 of the second blade 94 may engage with (e.g., at the upstream end portion 226 to form a fluidic seal with) the inner surface 230 of the first wall 74. As such, a width 270 between distal ends 272 of the first blade 90 and the second blade 94 may form an effective width of the outlet 88, which may be less than an overall width 274 of the outlet 88. In this way, the blades 100 reduce the effective cross-sectional area of the outlet 88 in the fourth discharge configuration 252. As a result, the blades 100 may facilitate discharge of the conditioned air 220 from the diffuser assembly 70 at a higher pressure and/or a higher velocity as compared to a pressure and/or velocity at which the conditioned air 220 is discharged from the diffuser assembly 70 while the blades 100 are in the neutral discharge configuration 202. As such, while the blades 100 are in the fourth discharge configuration 252, the blades 100 may enable the diffuser assembly 70 to more effectively direct conditioned air toward the floor 42 of the room 30 and/or further into the room 30, for example, compared to when the blades 100 are in the neutral discharge configuration 202.

In some embodiments, in the second adjustment configuration 192, the linkage mechanism 110 may be configured such that a particular degree of rotation of the first blade 90 about the first axis 92 in a first direction (e.g., the clockwise direction 212) induces a corresponding (e.g., substantially equal) degree of rotation of the second blade 94 about the second axis 96 in an opposite direction (e.g., the counter-clockwise direction 210), and vice versa. That is, in the second adjustment configuration 192, the linkage mechanism 110 may coordinate (e.g., synchronize) rotation the blades 100 such that at least a subset of the blades 100 (e.g., one or more of the blades 100) rotates in an opposite direction about their respective axes (e.g., counter-rotate) with respect to a direction of rotation of a remaining portion of the blades 100 about their respective axes. Moreover, it should be appreciated that the blades 100 may be transitioned to any suitable position (e.g., angular orientation) between the third discharge configuration 250 and the fourth discharge configuration 252 described above.

Figure 14:
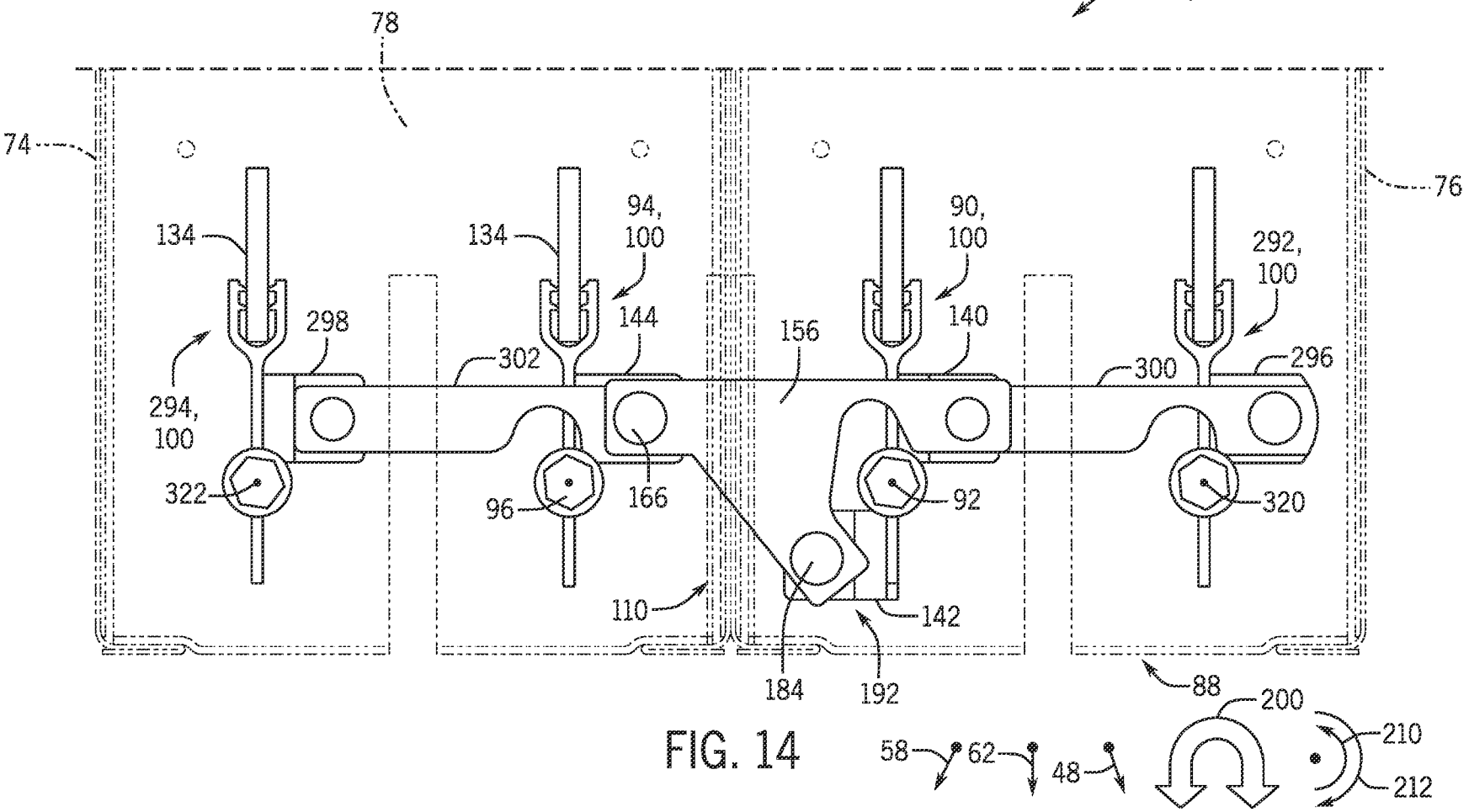
FIG. 14 is a side view of an embodiment of a portion of a diffuser assembly, in accordance with an aspect of the present disclosure.

FIG. 14 is a side view of a portion of another embodiment of the diffuser assembly 70, referred to herein as a diffuser assembly 290. In the illustrated embodiment, the diffuser assembly 290 includes the first blade 90, the second blade 94, a third blade 292, and a fourth blade 294. Indeed, as set forth above, it should be appreciated that the diffuser assembly 290 may include any suitable quantity of blades 100 and may be configured to operate in the manner discussed herein. The first blade 90, the second blade 94, the third blade 292, and the fourth blade 294 may be collectively referred to herein as the blades 100 of the diffuser assembly 290.

The third blade 292 includes a third bracket 296 coupled thereto or formed thereon, and the fourth blade 294 includes a fourth bracket 298 coupled thereto or formed thereon. The third bracket 296 may be pivotably coupled to the first bracket 140 of the first blade 90 via a first bridge 300 (e.g., a linkage, connector), and the fourth bracket 298 may be pivotably coupled to the pin bracket 144 of the second blade 94 via a second bridge 302 (e.g., a linkage, connector). Accordingly, the first bridge 300 may pivotably couple the third blade 292 to the first blade 90, such that movement of the first blade 90 about the first axis 92 in the clockwise direction 212 or the counter-clockwise direction 210 induces corresponding movement of the third blade 292 about a third axis 320 of the third blade 292 in the clockwise direction 212 or the counter-clockwise direction 210, respectively. Similarly, the second bridge 302 may pivotably couple the fourth blade 294 to the second blade 94, such that movement of the second blade 94 about the second axis 96 in the clockwise direction 212 or the counter-clockwise direction 210 induces corresponding movement of the fourth blade 294 about a fourth axis 322 of the fourth blade 294 in the clockwise direction 212 or the counter-clockwise direction 210, respectively. The first bridge 300 and the second bridge 302 may thus form a portion of the linkage mechanism 110.

In accordance with the aforementioned techniques, a user may transition the selection pin 184 between corresponding positions with the linkage mechanism 110 to transition the linkage mechanism 110 between the first adjustment configuration 190 and the second adjustment configuration 192. For example, while the linkage mechanism 110 is in the first adjustment configuration 190, the linkage mechanism 110 may couple the blades 100 such that application of the input force 200 to any of the blades 100 causes each of the blades 100 to rotate in unison (e.g., in the same direction) about their respective axes 92, 96, 320, 322 (e.g., in the clockwise direction 212 or the counter-clockwise direction 210). While the linkage mechanism 110 is in the second adjustment configuration 192, as shown in the illustrated embodiment of FIG. 14, the linkage mechanism 110 may couple the blades 100 such that rotation of the first and third blades 90, 292 in the counter-clockwise direction 210 about their respective axes 92, 320 induces rotation of the second and fourth blades 94, 294 in the clockwise direction 212 about their respective axes 96, 322, and vice versa. As such, the diffuser assembly 290 may be selectively adjustable to discharge air in the vertical direction 62, the first direction 48, the second direction 58, or a combination of both the first and second directions 48, 58.

As set forth above, embodiments of the present disclosure may provide one or more technical effects useful for enabling quick and user-friendly adjustment of an air discharge direction of a diffuser assembly. Indeed, by enabling directionally-adjustable air discharge, the diffuser assembly disclosed herein may facilitate effective, desired, and adjustable air distribution within a room or other space to be conditioned. In this way, the diffuser assembly may mitigate or substantially eliminate stratification of conditioned air within the room or space to be conditioned and/or enhance occupant comfort within the room or space. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f).

However, for any claims containing elements designated in any other manner, it is intended that such elements are not to be interpreted under 35 U.S.C. 112(f).

The invention claimed is:

1. A diffuser assembly for a heating, ventilation, and air conditioning (HVAC) system, the diffuser assembly comprising:

a housing configured to receive an air flow;

a first blade pivotably coupled to the housing and configured to rotate about a first axis relative to the housing;

a second blade pivotably coupled to the housing and configured to rotate about a second axis relative to the housing; and a linkage mechanism coupled to the first blade and the second blade, wherein the linkage mechanism is configured to transition between a first configuration and a second configuration, wherein, in the first configuration, the linkage mechanism is configured to induce rotation of the second blade about the second axis in a first direction in response to rotation of the first blade about the first axis in the first direction, wherein, in the second configuration, the linkage mechanism is configured to induce rotation of the second blade about the second axis in a second direction, opposite the first direction, in response to rotation of the first blade about the first axis in the first direction, and wherein the linkage mechanism comprises:

a first bracket coupled to the first blade;

a second bracket coupled to the first blade; and an intermediate bracket coupled to the second blade, wherein the intermediate bracket is configured to selectively pivotably couple to one of the first bracket and the second bracket.

2. The diffuser assembly of claim 1, wherein the intermediate bracket is pivotably coupled to the first bracket in the first configuration of the linkage mechanism, and the intermediate bracket is pivotably coupled to the second bracket in the second configuration of the linkage mechanism.

3. The diffuser assembly of claim 2, comprising a removable selection pin configured to pivotably couple the intermediate bracket to the first bracket in the first configuration and configured to pivotably couple the intermediate bracket to the second bracket in the second configuration.

4. The diffuser assembly of claim 1, wherein, in the second configuration, the linkage mechanism is configured to transition the first blade and the second blade to a first discharge configuration in which a first upstream end portion of the first blade is engaged with a second upstream end portion of the second blade.

5. The diffuser assembly of claim 4, wherein, in the second configuration, the linkage mechanism is configured to transition the first blade and the second blade to a second discharge configuration in which the first upstream end portion of the first blade is engaged with a first wall of the housing and the second upstream end portion of the second blade is engaged with a second wall of the housing.

6. The diffuser assembly of claim 1, comprising an actuator coupled to the first blade or the second blade, wherein the actuator is configured to drive actuation of the first blade, the second blade, and the linkage mechanism.

7. The diffuser assembly of claim 1, wherein the housing comprises a front wall, a rear wall, and a web extending between the front wall and the rear wall to define an interior volume of the housing, wherein the linkage mechanism is disposed within the interior volume.

8. The diffuser assembly of claim 7, wherein the housing comprises an outlet defined by the front wall, the rear wall, and the web and configured to discharge the air flow from the interior volume, wherein the linkage mechanism is user-accessible via the outlet to enable transition of the linkage mechanism between the first configuration and the second configuration.

9. The diffuser assembly of claim 1, comprising a third blade pivotably coupled to the housing and configured to rotate about a third axis, wherein the linkage mechanism comprises a bridge pivotably coupling the first blade and the third blade such that rotation of the first blade in the first direction about the first axis induces rotation of the third blade in the first direction about the third axis, and such that rotation of the first blade in the second direction about the first axis induces rotation of the third blade in the second direction about the third axis.

10. The diffuser assembly of claim 9, comprising a fourth blade pivotably coupled to the housing and configured to rotate about a fourth axis, wherein the linkage mechanism comprises an additional bridge pivotably coupling the second blade to the fourth blade such that rotation of the second blade in the first direction about the second axis induces rotation of the fourth blade in the first direction about the fourth axis, and rotation of the second blade in the second direction about the second axis induces rotation of the fourth blade in the second direction about the fourth axis.

11. A diffuser assembly for a heating, ventilation, and air conditioning (HVAC) system, the diffuser assembly comprising:

a first blade configured to rotate about a first axis;

a second blade configured to rotate about a second axis;

a linkage mechanism coupled to the first blade and the second blade, wherein the linkage mechanism is adjustable between a first configuration in which the linkage mechanism is configured to synchronize rotation of the first blade about the first axis and rotation of the second blade about the second axis in a common direction, and a second configuration in which the linkage mechanism is configured to synchronize rotation of the first blade about the first axis and rotation of the second blade about the second axis in opposing directions; and a selection pin configured to removably couple to the linkage mechanism in a first position corresponding to the first configuration and to removably couple to the linkage mechanism in a second position corresponding to the second configuration.

12. The diffuser assembly of claim 11, wherein the linkage mechanism comprises:

a first bracket extending from the first blade;

a second bracket extending from the first blade; and an intermediate bracket extending from the second blade, wherein the intermediate bracket is configured to pivotably couple to the first bracket in the first configuration of the linkage mechanism and to pivotably couple to the second bracket in the second configuration of the linkage mechanism.

13. The diffuser assembly of claim 12, wherein the selection pin is configured to pivotably couple the intermediate bracket to the first bracket in the first configuration of the linkage mechanism, and the selection pin is configured to pivotably couple the intermediate bracket to the second bracket in the second configuration of the linkage mechanism.

14. The diffuser assembly of claim 11, comprising a housing of the diffuser assembly, wherein the housing is configured to receive an air flow from a duct of the HVAC system, wherein the first blade, the second blade, and the linkage mechanism are disposed within an interior volume of the housing, and wherein the first blade and the second blade are configured to guide discharge of the air flow from the housing.

15. The diffuser assembly of claim 14, wherein:

in the first configuration, the linkage mechanism is configured to position the first blade and the second blade to direct discharge of substantially all of the air flow in a first direction or in a second direction, wherein the first direction is crosswise to the second direction; and in the second configuration, the linkage mechanism is configured to position the first blade and the second blade to direct discharge of a first portion of the air flow in the first direction and to direct discharge of a second portion of the air flow in the second direction.

16. A diffuser assembly for a heating, ventilation, and air conditioning (HVAC) system, the diffuser assembly comprising:

a housing configured to receive an air flow;

a plurality of blades pivotably coupled to the housing and configured to rotate about respective axes relative to the housing; and a linkage mechanism coupled to the plurality of blades, wherein the linkage mechanism comprises an intermediate linkage configured to selectively pivotably couple to a first linkage of the linkage mechanism or to a second linkage of the linkage mechanism to transition the linkage mechanism between a first configuration and a second configuration, wherein, in the first configuration, the linkage mechanism is configured to induce rotation of the plurality of blades about the respective axes in a common direction in response to application of an input force to a blade of the plurality of blades, and wherein, in the second configuration, the linkage mechanism is configured to induce rotation of a first subset of the plurality of blades in a first direction and induce rotation of a second subset of the plurality of blades in a second direction, opposite the first direction, in response to application of the input force.

17. The diffuser assembly of claim 16, wherein the plurality of blades is configured to guide discharge of the air flow from the housing, wherein, in the first configuration, the linkage mechanism is configured to position the plurality of blades to guide discharge of substantially all of the air flow from the housing in a first direction or in a second direction, wherein the first direction is crosswise to the second direction.

18. The diffuser assembly of claim 17, wherein, in the second configuration, the linkage mechanism is configured to position the first subset of the plurality of blades to guide discharge of a first portion of the air flow in the first direction and to position the second subset of the plurality of blades to guide discharge of a second portion of the air flow in the second direction.

19. The diffuser assembly of claim 17, wherein the housing comprises an outlet configured to discharge the air flow from the housing, wherein, in the second configuration, the linkage mechanism is configured to position the plurality of blades in a discharge configuration in which an effective cross-sectional area of the outlet is reduced by the plurality of blades.

20. The diffuser assembly of claim 11, wherein, in the first position, the selection pin extends through a first aperture of the linkage mechanism, and, in the second position the selection pin extends through a second aperture of the linkage mechanism.

* * * * *